US006205683B1

(12) United States Patent
Clark et al.

(10) Patent No.: US 6,205,683 B1
(45) **Date of Patent: *Mar. 27, 2001**

(54) SHOCK DIFFUSING, PERFORMANCE-ORIENTED SHOES

(75) Inventors: Douglas E. Clark, Durham; Joseph D. Boyer, Newington, both of NH (US); Bruce N. Todtfeld, Marblehead, MA (US); Lee A. Schuette, Kittery Point; Stephen R. Roux, Sanford, both of ME (US)

(73) Assignee: The Timberland Company, Stratham, NH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/866,473

(22) Filed: May 30, 1997

(51) Int. Cl.[7] ..... A43B 13/12; A43B 13/14

(52) U.S. Cl. ..... 36/30 R; 36/31; 36/107; 36/102; 36/114

(58) Field of Search ..... 36/25 R, 30 R, 36/30 A, 31, 107, 108, 76 R, 76 C, 114, 43, 69, 88, 102

(56) References Cited

U.S. PATENT DOCUMENTS

| | | | | |
|---|---|---|---|---|
| 1,566,364 | | 12/1925 | Blair . | |
| 2,274,205 | * | 2/1942 | Mann | 36/43 |
| 2,817,163 | * | 12/1957 | Clark | 36/17 |

(List continued on next page.)

FOREIGN PATENT DOCUMENTS 2 114 869 9/1983 (GB) .

OTHER PUBLICATIONS

ACTA Orthopædica Belgica vol. 61/3—National Library of Medicine—Nov. 1995 (10 pp.).

(List continued on next page.)

*Primary Examiner*—M. D. Patterson
(74) *Attorney, Agent, or Firm*—Orrick, Herrington & Sutcliffe LLP

(57) ABSTRACT

A combination insole board includes a shock diffusion plate for diffusing the shock of a heel strike and for providing torsional stiffness in the heel and midfoot areas and includes a flexible material in the forepart of the insole board. The semi-rigid shock diffusion shock diffusion plate is engineered with a contour which loosely correlates to the foot morphology. At least two alternative shoe construction methodologies may be used for incorporating a combination insole board into a shoe according to the present invention. In a first embodiment, the shock diffusion plate is attached to the flexible forepart to form the combination insole board. In this embodiment, the combination insole board is tacked to a shoemaker's last either mechanically or adhesively, an upper having a sufficient lasting margin extending beyond the feather edge is pulled over the last and the lasting margin is attached to the combination insole board with a suitable adhesive. In a second embodiment, an upper having a lasting margin only in the heel and midfoot areas is Strobel stitched to the flexible material along the feather edge, the shock diffusion plate is adhered to the last, the last is inserted into the upper, and the lasting margin is attached to the shock diffusion plate with adhesive. After attaching the upper to the insole board, a midsole and outsole are added, and an orthotic which conforms anatomically to the shape of the bottom of the foot and which is preferably more closely contoured to the morphology of the foot than the shock diffusion plate may be added. A shoe made according to either of these methods disperses the force of a heel strike to significantly reduce cumulative underfoot pressures.

1 Claim, 8 Drawing Sheets

U.S. PATENT DOCUMENTS

| | | | | |
|---|---|---|---|---|
| 3,735,511 | * | 5/1973 | Gilbert et al. | 36/44 |
| 4,020,569 | | 5/1977 | Fukuoka . | |
| 4,128,950 | | 12/1978 | Bowerman et al. . | |
| 4,231,169 | | 11/1980 | Toyama et al. | 36/43 |
| 4,288,929 | | 9/1981 | Norton et al. . | |
| 4,481,726 | * | 11/1984 | Phillips | 36/30 A |
| 4,662,018 | | 5/1987 | Autry . | |
| 4,694,591 | * | 9/1987 | Banich et al. | 36/102 |
| 4,852,275 | * | 8/1989 | Bianchini et al. | 36/102 |
| 4,854,057 | | 8/1989 | Misevich et al. | 36/114 |
| 4,879,821 | | 11/1989 | Graham et al. . | |
| 5,042,174 | * | 8/1991 | Nichols | 36/25 R |
| 5,070,629 | | 12/1991 | Graham et al. . | |
| 5,185,943 | | 2/1993 | Tong et al. . | |
| 5,247,742 | | 9/1993 | Kilgore et al. . | |
| 5,295,314 | * | 3/1994 | Moumdjian | 36/25 R |
| 5,402,588 | | 4/1995 | Graham et al. . | |
| 5,561,920 | | 10/1996 | Graham et al. . | |
| 5,775,005 | * | 7/1998 | Mcclelland | 36/31 |

OTHER PUBLICATIONS

A Biomechanical Comparison of the Running Shoe and the Combat Boot—CPT Richard G. deMoya, IN, USA—Military Medicine, vol. 147—May 1982 (4 pp.).

Biomechanics of Running Shoe Performance—Stephen D. Cook, Ph.D., Marcus A. Kester, Ph.D., Michael E. Brunet, M.D. and Ray J. Haddad, Jr., M.D.—Clinics in Sports Medicine—vol. 4, No. 4, Oct. 1985 (8 pp.).

Applied Sciences Biodynamics—The Movement of the Heel Within a Running Shoe, Alex Stacoff, Christoph Reinschmidt and Edgar Stüssi, Biomechanics Laboratory, Swiss Federal Institute of Technology (ETH), CH–8952 Schlieren Switzerland—Medicine and Science in Sports and Exercise, vol. 24, No. 6—1991 (7 pp.).

Advertisement—Runner's World (vol. 17 No. 10—Oct. 1982)—The Etonic Alpha 1.

Advertisement—Runner's World (vol. 17, No. 10—Oct. 1982)—Saucony's Next Step: Dixon and Lady Dixon.

Advertisement—Runner's World (vol. 18, No. 10—Oct. 1983)—Saucony Magic.

* cited by examiner

SHOCK DIFFUSING, PERFORMANCE-ORIENTED SHOES

FIELD OF THE INVENTION

This invention relates to a novel approach for integrating a means, in the rear of a shoe, for providing shock diffusion and torsional stiffness (rigidity) in a shoe construction methodology which lends itself to the economical production of shoes for performance applications including running, hiking and sustained walking. The shoe constructed by this methodology is lightweight and disperses pressure both throughout the top of the midsole and across more of the foot surface than in a shoe made according to more conventional construction techniques.

BACKGROUND OF THE INVENTION

The heel is generally the first part of the foot to impact the ground. This heel strike, as it is generally known, places extra stress on the heel and can lead to unnecessary repetitive motion injury. Shoe designers have long recognized that shock absorption and diffusion are necessary to reduce the stress on initial impact of the heel. Means have therefore been provided within the soles of shoes for some of the impact on the heel to be absorbed by the sole and diffused away from the heel area. The attempt has been to spread the force concentrated in a small area of the heel over a larger area to avoid a local "sore spot".

Past attempts to diffuse the force of a heel strike have usually involved the addition of complicated structures to the shoe which added additional and sometimes complicated manufacturing steps. For example, in U.S. Pat. No. 1,566,364, Blair discloses a spring member made of steel which is disposed between the outsole and inner lining and extends into a recess under the heel. The spring member in conjunction with optional sponge rubber inserted in the recess is said to relieve the shock of the heel strike. As another example, in U.S. Pat. No. 5,185,943, Tong et al. disclose providing cushioning, stability and support in an athletic shoe by adding an insert which must be positioned between the midsole and outsole or encapsulated within the midsole or outsole. It is also known in the prior art to add a steel shank between the insole and outsole to support the shank area of the shoe and the arch of the foot. It is further known in the prior art to incorporate a tuck support into the insole board such as with a reinforced piece of texon board.

Basic shoe construction techniques have to some degree added inherent shock diffusion properties to the shoes manufactured by them. For example, a basic cement construction technique involves tacking an insole board to the shoemaker's last and cementing the marginal edges of the shoe upper—so called "lasting margins"—to the insole board. Such shoes are completed by the addition of an outsole and optionally a midsole. In addition, a sock liner or full orthotic was added to complete the interior of the shoe. Special purpose footwear incorporated lining materials to insulate the shoe and/or add waterproof-breatheability characteristics to the upper.

The use of a traditional full length insole board is a relatively poor structure to serve as the foundation for a shock diffusion system, even if combined with an appropriate sock liner or orthotic and a midsole with the appropriate elastic/damping properties. The material commonly used for such prior art insole boards (e.g. Texon board) is not sufficiently rigid to properly transmit and spread the localized force to the entire midsole because it must flex in the forefoot region in order to accommodate a normal walking or running gait. In addition, the use of a full length insole board does not permit the designer to select the area of the midsole which will bear the primary load in diffusing the shock of the initial heel strike.

The conventional use of a flat last to assemble shoes has also hindered the ability to diffuse the force of heel strike because the flat lasting technique does not permit the use of an insole board contoured to the shape of the foot. As a result, the force of the heel strike remains concentrated in the vicinity of the local sore spot.

There is therefore a need for achieving increased shock diffusion of the initial heel strike but limiting the shock diffusion to the heel and arch areas of the foot without compromising the maximum flexibility required in the forepart region of the shoe.

Another problem that has been addressed by the footwear industry is excess pronation (i.e., the outward rotation or twisting of the foot) which causes injuries. Solving this problem has led shoe designers to incorporate complex pronation control devices. For example, in U.S. Pat. No. 4,288,929, Norton et al. disclose a device which comprises an additional plastic piece attached between a lasted upper and the outsole, the plastic piece having medial and lateral walls formed around the heel. Another pronation control device, which is incorporated into the midsole, is disclosed in Kilgore et al. in U.S. Pat. No. 5,247,742.

It is therefore also advantageous to incorporate a device for reducing excessive pronation without adding additional components.

SUMMARY OF THE INVENTION

It is an object of this invention to provide in footwear a means which maximizes shock diffusion and torsional stiffness in the heel and midfoot area but, to reduce foot fatigue, does not compromise flexibility in the forefoot area where it would place undesirable stress on the metatarsals.

It is a further object of this invention to provide a means for shock diffusion which is simple and economical to fabricate.

It is a further object of this invention to provide a shoe wherein the pressure from the heel strike is dispersed directly under the foot and is further dispersed throughout the top of the midsole by exploiting more of the surface areas available under the foot as well as on top of the midsole for shock absorption.

It is a further object of this invention to provide a shoe construction methodology which uses a contoured last to construct a shoe having an insole board and sock liner which are contoured in the heel and arch areas.

It is a further object of this invention to provide arch support which cradles the foot and offers superior medial and lateral stability to reduce rearfoot motion during human locomotion.

It is a further object of this invention to provide a shoe whose properties will not degrade over time.

It is a further object of this invention to accomplish the above objectives while further enhancing the performance of multi-purpose outdoor footwear by providing an outsole with distinct zones, each zone maximized to perform the function specifically required at that portion of the gait cycle where such zone is utilized.

These objectives are accomplished in a shoe comprising a novel combination insole board in combination with a midsole and an outsole. The combination insole board comprises a semi-rigid shock diffusion plate in the heel and arch areas of the shoe to permit the diffusion of the force placed on the shoe during heel strike by a wearer. The combination insole board further comprises a flexible material in the forepart area of the shoe and attached to the shock diffusion plate. The shock diffusion plate, which may be loosely contoured to a foot morphology, also advantageously increases torsional stiffness.

In one preferred embodiment, the shoe comprises a single piece midsole extending substantially throughout the length of the shoe. In another embodiment, the midsole is comprised of two separate sections, a first section underlying the heel area and a second section underlying the forepart area. Depending on the type of end use for which the shoe is designed, the midsole may be made from either polyurethane, die cut ethylene vinyl acetate (EVA), compression molded EVA, polyvinyl chloride or thermoplastic rubber.

An orthotic, which is more closely contoured to the foot morphology than the shock diffusion plate, is preferably inserted into the shoe. A preferred orthotic comprises a blend of polyethylene and EVA.

The contoured orthotic, shock diffusion plate and midsole work in conjunction to diffuse the force of heel strike.

The shoe of the present invention may be constructed according to a first methodology comprising the steps of attaching a front portion of said shock diffusion plate to a rear portion of said flexible material to form a combination insole board, pulling the upper over a shoemaker's last, and attaching the combination insole board to the lasting margin of the upper.

Alternatively, the shoe may be constructed according to a second methodology comprising the steps of Strobel stitching the flexible material to the upper along the feather edge in the forepart of the shoe, attaching the shock diffusion plate to a shoemaker's last, inserting the last into the combination of the upper and the flexible material, and attaching the shock diffusion plate to the lasting margin of the upper.

DETAILED DESCRIPTION OF THE PREFERRED EMBODIMENTS

Figure 1:
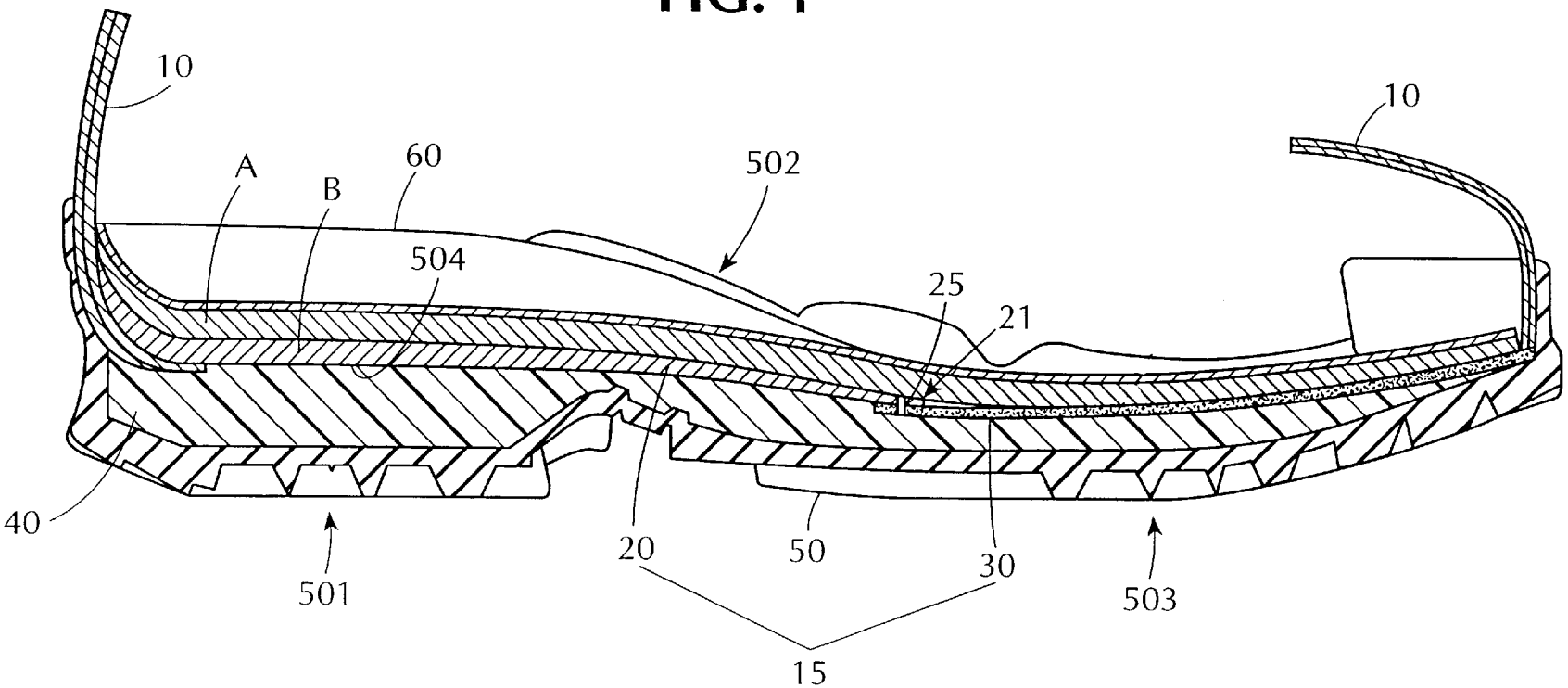
FIG. 1 is a lengthwise cross-sectional view of the sole and a portion of the upper of the shoe of the present invention.

FIGS. 1–16 illustrate two preferred embodiments of the invention. The shoe comprises an upper 10, combination insole board 15, a midsole 40 beneath the combination insole board 15, and an outsole 50. The shoe has a heel area 501, an arch area 502 and a forepart area 503. The midsole has a top face 504.

Figure 2:
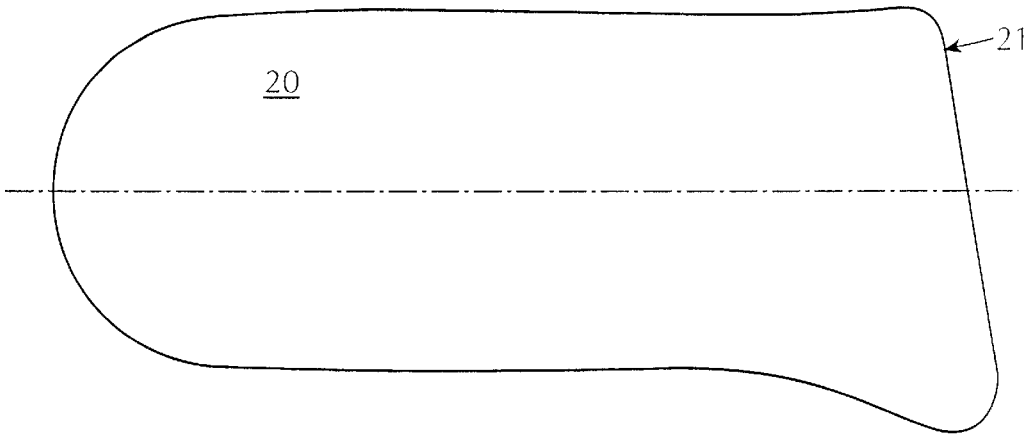
FIGS. 2–3 are top and side views, respectively, of the shock diffusion plate.
Figure 3:
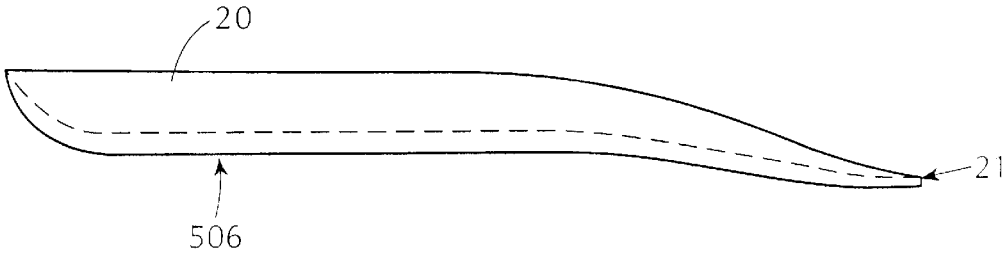
Figure 4:
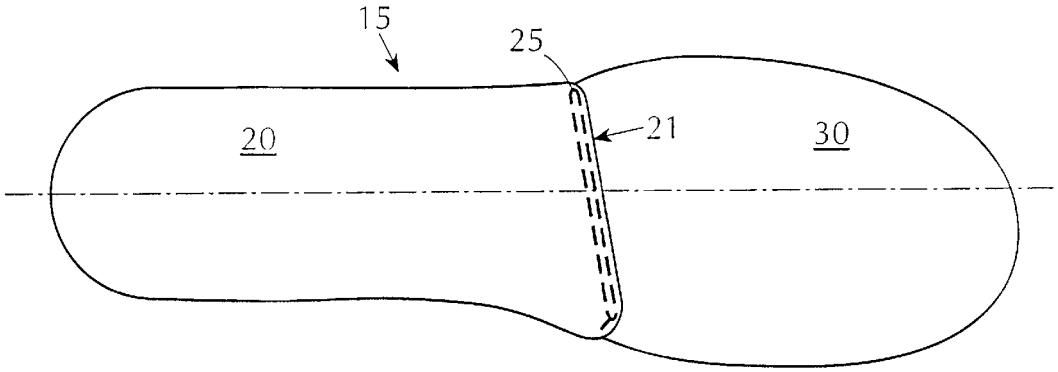
FIG. 4 is a top view of a shock diffusion plate attached to a flexible forepart for use in an otherwise traditional cement construction technique.

There are at least two basic construction techniques which lend themselves to utilizing the present invention. In one such technique, a combination insole board 15 as shown in FIG. 4 is constructed by attaching a shock diffusion plate 20 of sufficiently rigid material to a more flexible forepart 30 which may be a thin flexible composite material. The relatively rigid shock diffusion plate 20 is joined to the relatively flexible forepart by appropriate means such as stitching or gluing at 25. Shock diffusion plate 20, which is engineered (preformed at the time of molding) with a contour which loosely correlates to the foot morphology, extends from the heel, where it is cup-shaped, to just beyond the arch at point 21. (FIGS. 2 and 3). The shape of the contour is designed to meet the needs of virtually all normal foot ranges. It is important that the shock diffusion plate 20 not extend into the forepart area of the shoe where it would interfere with the normal function of the metatarsal heads. The shock diffusion plate has a bottom surface 506.

In addition to improved shock diffusion, the contour of the shock diffusion plate 20 creates a secure foot placement, provides support which cradles the foot, and offers superior medial and lateral stability to the rear foot during human locomotion.

In the embodiment utilizing a combination insole board shown in FIG. 4, the shoe may be constructed in accordance with traditional shoe making techniques. Following one such technique, the combination insole board 15 shown in FIG. 4 is tacked mechanically or adhesively to a contoured shoemaker's last which in the heel and arch portions conforms to the contours of the top of shock diffusion plate 20. Prior to this step, an appropriate liner can be pulled over the last if desired. Such liners may incorporate insulation and/or a waterproof-breathable membrane depending on the environment in which the shoe is intended to perform.

Figure 5:
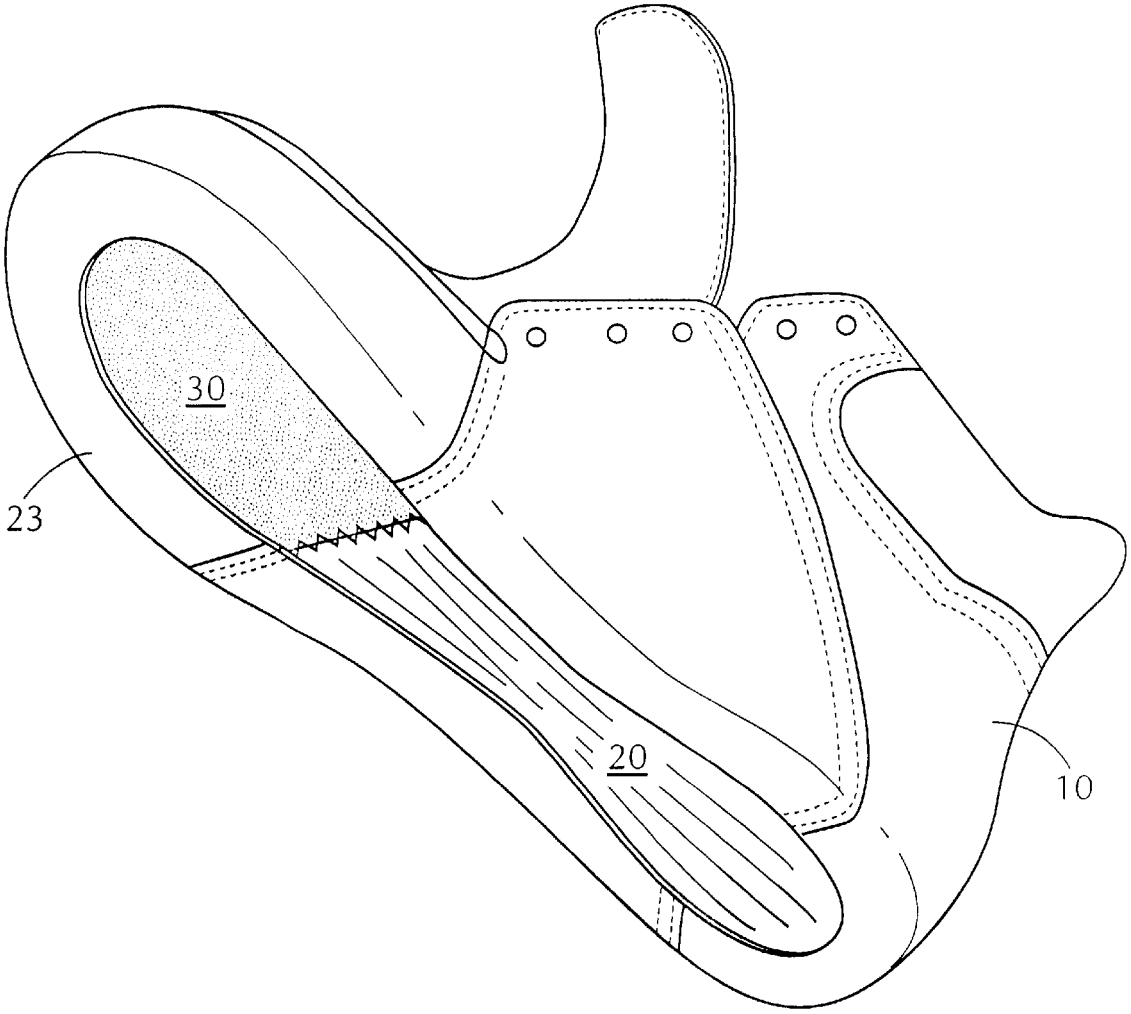
FIG. 5 is a bottom perspective view of a completed upper using the shock diffusion plate of FIG. 4 in a cement construction.

The materials forming the upper 10 are cut and sewn, leaving a suitable lasting margin 23 beyond the feather edge for attachment to the combination insole board 15. The upper is then pulled over the last and the lasting margin 23 (FIG. 5) is attached to the combination insole board by known construction techniques involving the use of a suitable adhesive to adhere the inner surface of the lasting margin of the upper to the bottom surface of the peripheral edge of the combination insole board 15. An upper completed according to this embodiment is shown in FIG. 5.

Figure 6:
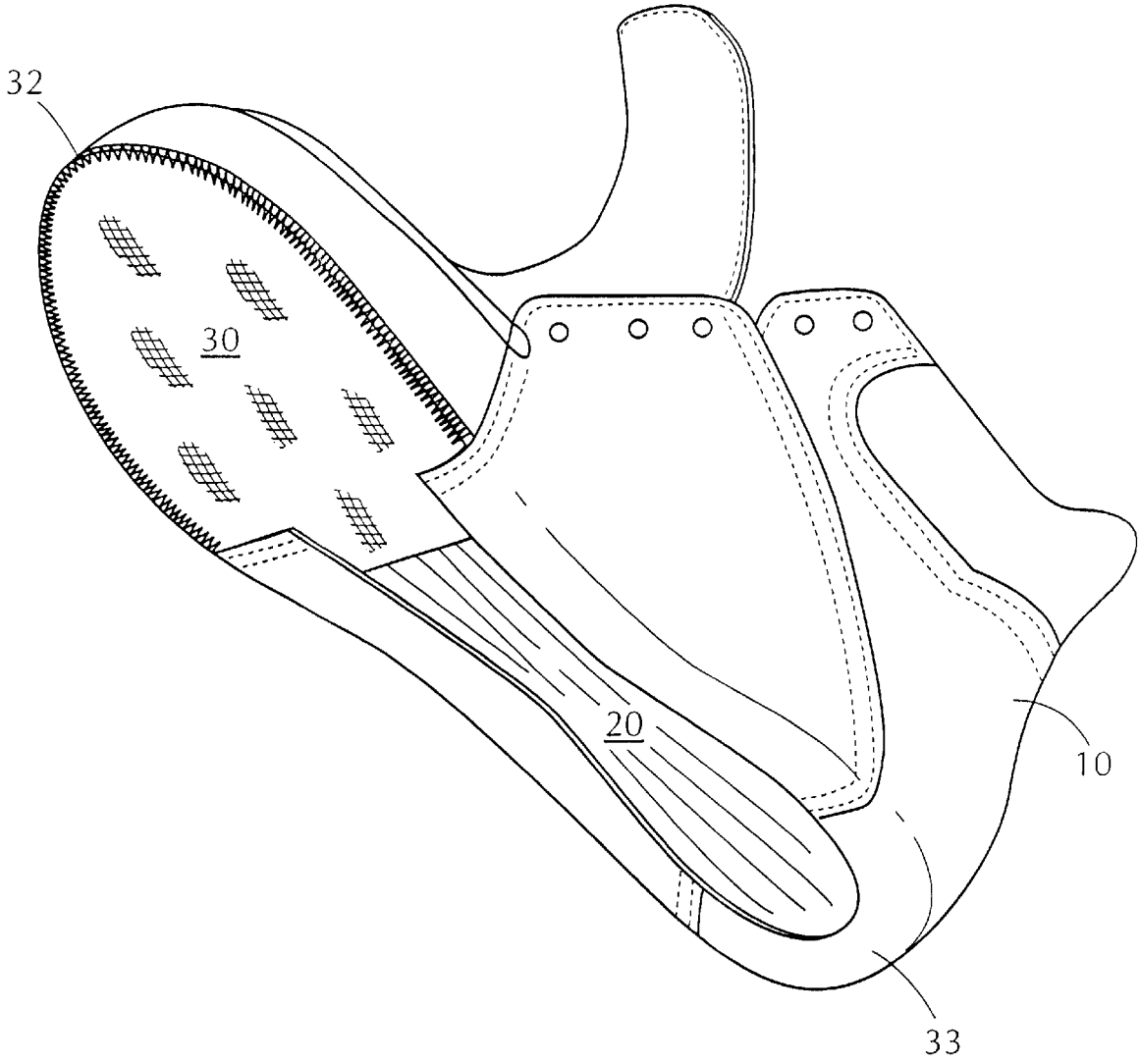
FIG. 6 is a bottom perspective view of a preferred embodiment which utilizes a combination construction technique with a Strobel stitched forepart completed by cement construction incorporating the shock diffusion plate in the heel and midfoot areas.

In an alternative embodiment shown in FIG. 6, the upper 10 incorporates a forepart 12 which lends itself to a Strobel type construction and a rear part 13 which includes a lasting margin for cement attachment to the shock diffusion plate. The materials forming the upper 10 are cut and sewn together. In this case, however, the forepart 12 of the upper material terminates at the feather edge 32 while the rear part 13, corresponding to the portion in registration with the shock diffusion plate 20, includes a regular lasting margin 33. Insole forepart 30 comprising a woven material is Strobel stitched to the forepart of the upper.

In this alternative embodiment of FIG. 6, the shock diffusion plate 20 is adhered to a shoemaker's last which may be prefitted with a lining package as desired. The last is then slipped into the upper and the lasting margin of the rear part is pulled over the shock diffusion plate 20 which is adhered to the last in the rear portion. The inside of the lasting margin is cemented to the exposed peripheral edge of the shock diffusion plate 20. In this embodiment, the shock diffusion plate 20 need not be stitched at 25 to the forepart 30.

It is now apparent that whichever of these two alternative techniques is used, the result is a lasted upper with certain desirable characteristics. In both cases, the forepart is flexible and will not in itself interfere with the normal operation of the metatarsal heads. Conversely, the rear part, which does not require flexibility, has a relatively rigid shock diffusion plate incorporated as part of a traditional shoemaking technique. Thus, the benefits of a shock diffusion mechanism may be incorporated in a shoe without a significant departure from traditional shoemaking techniques.

The precise materials and the appropriate flexibility of the shock diffusion plate and flexible forepart used in a particular shoe will depend on the type of end use for which the shoe is designed. The chart below indicates the heel and forefoot performance needs for five types of end uses.

| End Use | Heel Performance Needs | Forefoot Performance Needs |
|---|---|---|
| 1. Enthusiast Hiking | maximum rigidity | intermediate rigidity |
| 2. Recreational Hiking | intermediate rigidity | intermediate rigidity |
| 3. Multi-Purpose | intermediate rigidity | superior flexibility |
| 4. Walking (Normal) | intermediate rigidity | superior flexibility |
| 5. Walking - Fitness (more rugged than end use 4) | moderate rigidity | superior flexibility |

In order to achieve the superior flexibility for forefoot performance in end uses 3–5, in the second embodiment, upper 10 is strobel stitched to forepart 30, and the upper lasting margin of the first embodiment, which inhibits the flexing of the forefoot, is eliminated.

Materials suitable for shock diffusion plate 20 include glass-filled nylon, composites, nylon, polypropelene, and PVC. Materials suitable for the forefoot include non-woven or woven fabrics, such as polyester, Hytrel, thin texon board, composites, PVC, polypropelene, nylon, a very flexible plastic material, or another flexible material which may be stitched, glued or cemented to upper 10. (If the forepart 30 is to be cemented, the material from which it is made must not absorb cement which would impart rigidity and cause it to loose its flexibility.) The precise compositions and part geometry needed to achieve the above-specified heel and forefoot performance needs may vary. Suitable choices can be selected by one of ordinary skill in the art.

Figure 7:
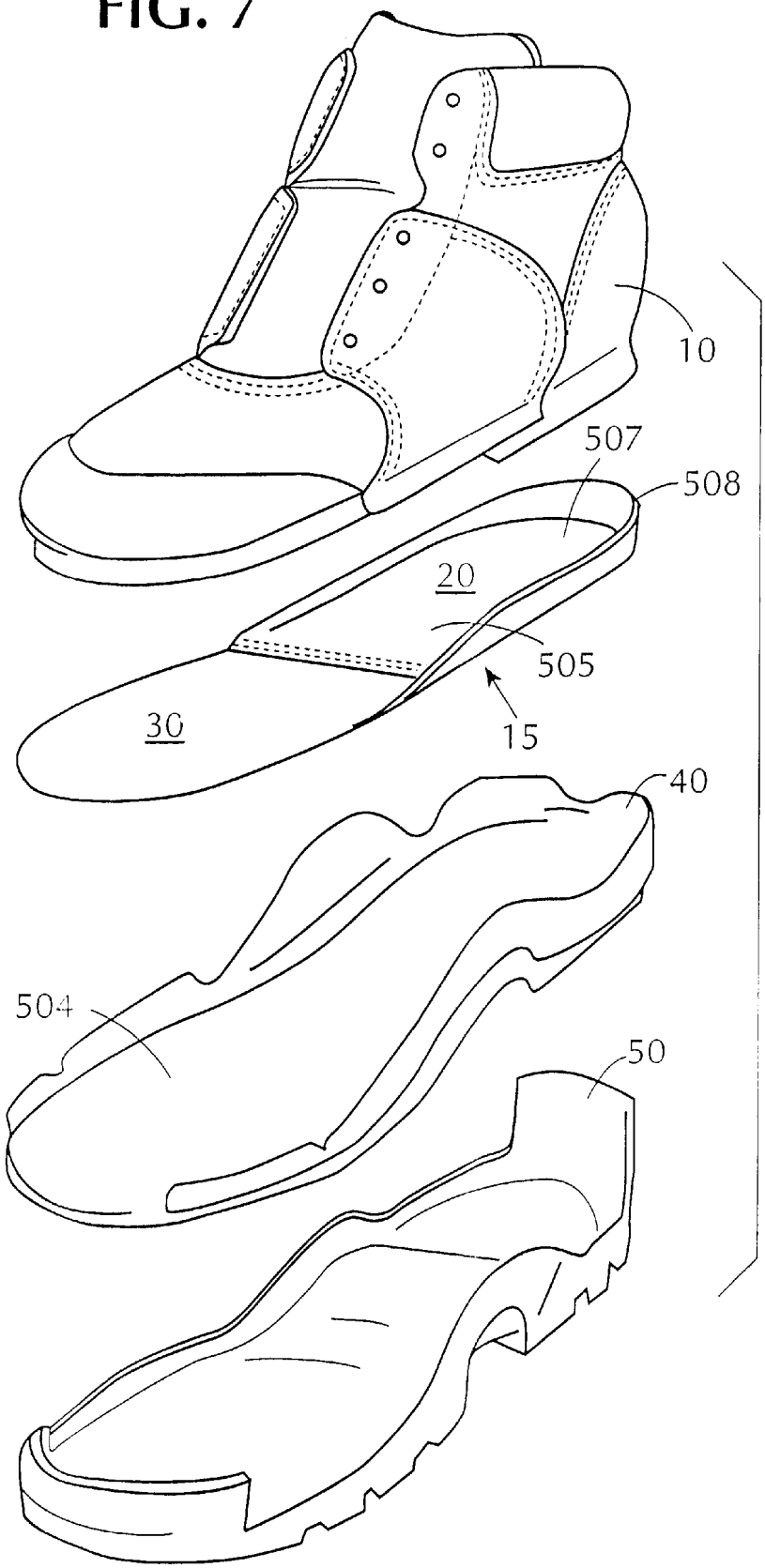
FIG. 7 is an exploded view of the, completed upper shock diffusion plate attached to the flexible forepart, midsole and outsole according to the present invention.

FIG. 7 is an exploded view of a basic shoe design incorporating the invention. As shown, the completed upper 10, which may be prepared in accordance with FIG. 5 or FIG. 6, is combined with at least three additional elements for the proper functioning of the shock diffusion plate of the present invention: the shock diffusion plate 20, the midsole 40 and the outsole 50. While the completed upper is still on the last, a bottoming operation is required to incorporate the midsole 40 and a durable outsole 50 as further described below. The diffusion plate 20 has a top surface 505 with a central portion 507 and a U-shaped periphery 508.

As shown in FIG. 1, midsole 40 lies between the wear-resistant outsole 50 and shock diffusion plate 20. Midsole 40 functions in the shock diffusion mechanism of the sole as described below. The rear section of midsole 40 lies underneath the shock diffusion plate. The rear section of midsole 40 is tailored to the requirements of the intended environment for the shoe by adjusting its thickness, material selection or the use of multiple layers of midsole material of differing characteristics. Generally, midsole 40 is a single piece of material which is more rigid under the shock diffusion plate 20 to provide enhanced shock diffusion and which is more flexible in the forepart 30 of the combination insole board.

Midsole 40 may be made from a variety of materials, the particular materials being dependent on the end use and type of shoe. In each case, the specified preferred material has the least compression set. For hiking shoes, midsole 40 should preferably be made of molded polyurethane. However, die cut EVA, which is softer, lighter and more flexible than polyurethane, may be used. For multi-purpose shoes, compression-molded EVA is the preferred material for midsole 40, but again die cut EVA is an acceptable alternative. For walking, whether normal or fitness walking, midsole 40 is preferably made of compression-molded EVA, but polyurethane is also acceptable. For boots, midsole 40 is made of one of the following materials listed in order of decreasing preference (because of a decreasing quality of the compression set characteristics): polyurethane, polyvinyl chloride (PVC), thermoplastic rubber (TPR), and EVA.

The outsole 50 is made of a material designed for long wear and good traction. Appropriate materials for outsole 50 may be, in order of descending preference, compression-molded rubber, polyurethane, TPR, PVC and EVA.

After the shoe is removed from the last, an orthotic 60 with integral arch support is placed inside the shoe. The orthotic 60, which conforms anatomically to the shape of the bottom of the foot, can be shaped to meet the needs of a majority of foot ranges meet the needs of specific foot ranges. Orthotic 60 orients the foot to the ground to align the leg joints. Orthotic 60 also provides some cushioning to the wearer's foot and is designed to prevent localized stress concentrations as otherwise might be experienced at the heel and the ball of the foot.

For those whom the orthotic is unsuitable, orthotic 60 may be replaced with a flat sock liner, although this will reduce the effect of shock diffusion.

Orthotic 60 is preferably made from a blend of polyethylene and EVA. For hiking, the blend preferably consists of 50% polyethylene and 50% EVA; for multipurpose footwear, the preferred blend consists of 35% polyethylene and 65% EVA; and for walking, the preferred blend consists of 25% polyethylene and 75% EVA. The blend preferred for outsoles of hiking shoes has the largest amount of polyethylene because it is desirable to provide hiking shoes with the least compression set to maintain their ruggedness. EVA, by contrast, takes a permanent compression set quickly.

The operation of the shock diffusion mechanism of the present invention will now be described. Upon the initial heel strike, because the orthotic 60 is contoured to conform to the morphology of the bottom of the foot, the orthotic 60 does not allow significant deformation of the foot itself and therefore spreads the pressure of the heel strike over a larger area of the foot than a flat orthotic. Thus, a local "sore spot" is avoided because the normal configuration of the foot is better maintained and not subject to as much local deformation. The force is transmitted by the orthotic 60 to the relatively rigid shock diffusion plate 20 which is contoured to loosely correlate to the foot morphology. The contouring of shock diffusion plate 20 disperses the force of the heel strike transmitted by orthotic 60 throughout the shock diffusion plate 20 including the heel and arch areas. The force is in turn transmitted by the relatively rigid shock diffusion plate 20 to the midsole 40 and is spread over the entire midsole area covered by the shock diffusion plate. By limiting the shock diffusion plate 20 to the rear part of the sole, the force is diffused directly by the plate only to the heel and arch (the arch is an area which does not generally receive much pressure in traditional flat-lasted, soft-bottomed footwear). This combination of structural elements allows the bones and soft tissues of the foot to function more naturally, i.e., the way they would interact when walking barefoot on packed soil. Moreover, the force dispersion significantly reduces cumulative underfoot pressures.

This force spreading characteristic of the shock diffusion plate 20 has the effect of involving more of the midsole material in shock absorption and rebound. Thus, more efficient use is made of the midsole material because the force is being spread over a larger area. In some cases this may permit the use of a thinner midsole, thereby saving weight and cost. This pressure spreading as well as the torsional stiffness in the rear of the shoe provided by the present construction produces a more stable rearfoot platform less subject to lateral instability which otherwise occurs with the use of shock absorbing midsoles. In addition, the combination construction of the present invention yields superior forefoot flexibility without compromising the desirable function of the rearfoot shock diffusion system. During the propelling and push-off stage of motion, even greater flexibility and control is achieved where the forefoot section of insole board 15 is Strobel stitched according to the second embodiment.

As will now be described, the midsole 40 and outsole 50 can be constructed in various embodiments which enhance the operation of the shock diffusion mechanism incorporated in the rearfoot area while maximizing the flexibility inherent in the combination construction of the present invention.

Figure 8:
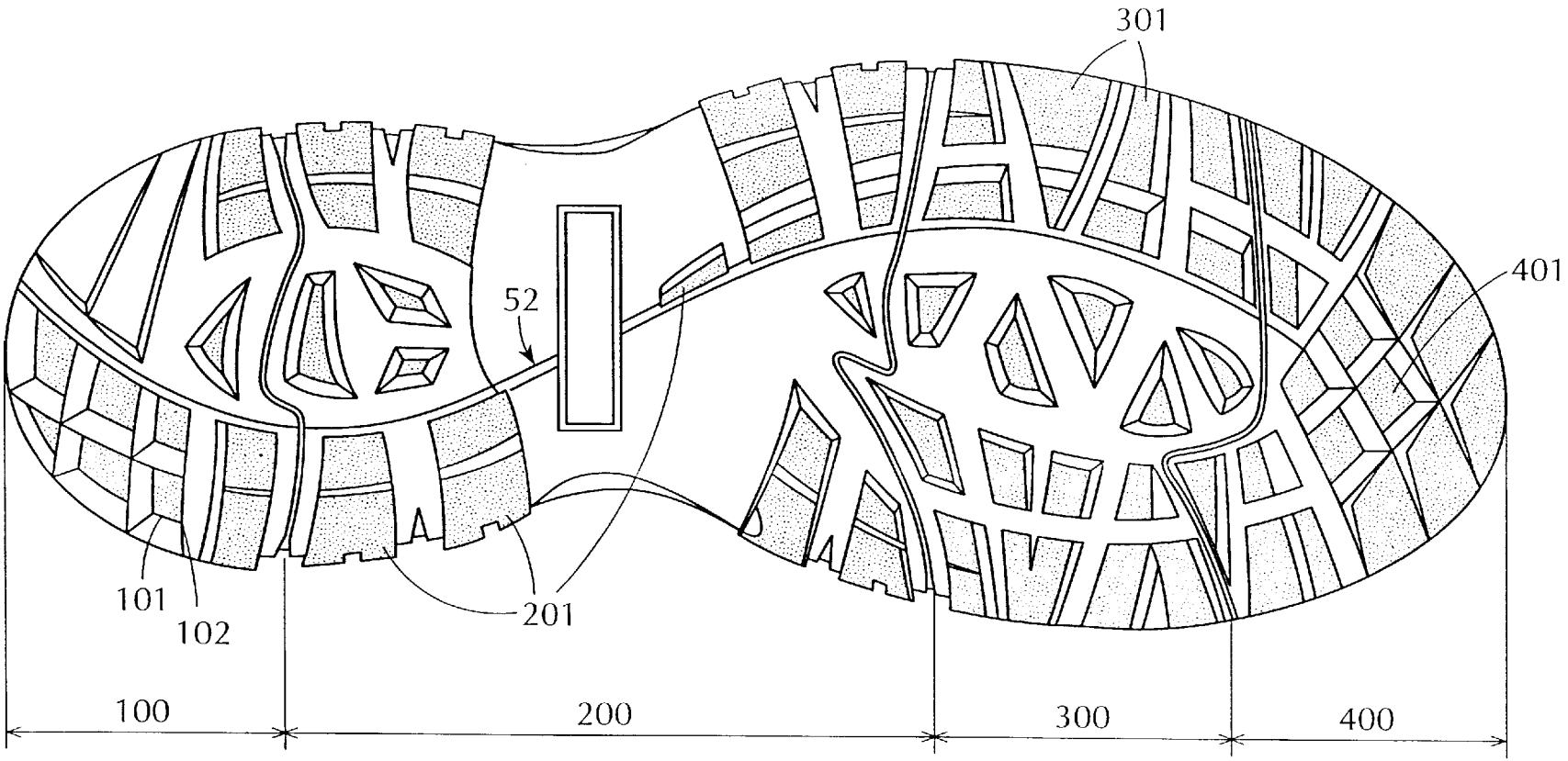
FIG. 8 is a bottom view of one embodiment of an outsole of a shoe incorporating the present invention.

The outsole 50 is shown in bottom view in FIG. 8. It is separated into four distinct zones running from heel to toe as follows: the "brake" zone 100 with integral lugs or cleats 101 with undercut forward edges 102 aligned to oppose directional forces to enhance the braking function upon heel strike (i.e., the alignment of the lugs increases the coefficient of friction, thereby increasing the traction); the "support" zone 200 with integral lugs or cleats 201 designed to provide support along the curve following the normal track of weight transfer longitudinally across the foot following the heel strike; the "flex" zone 300 with integral lugs or cleats 301 designed not to interfere with the natural flex lines of the foot; and the "propel" zone 400 with integral lugs or cleats 401 having edges aligned as in the "brake" zone designed to enhance the "bite" of the shoe in the toe area when traction is required prior to the foot lifting from the ground. To optimize their effectiveness, the lugs follow an S-shaped curve 52 from front to back, which is the pressure path the foot follows during a complete foot strike cycle.

Figure 9:
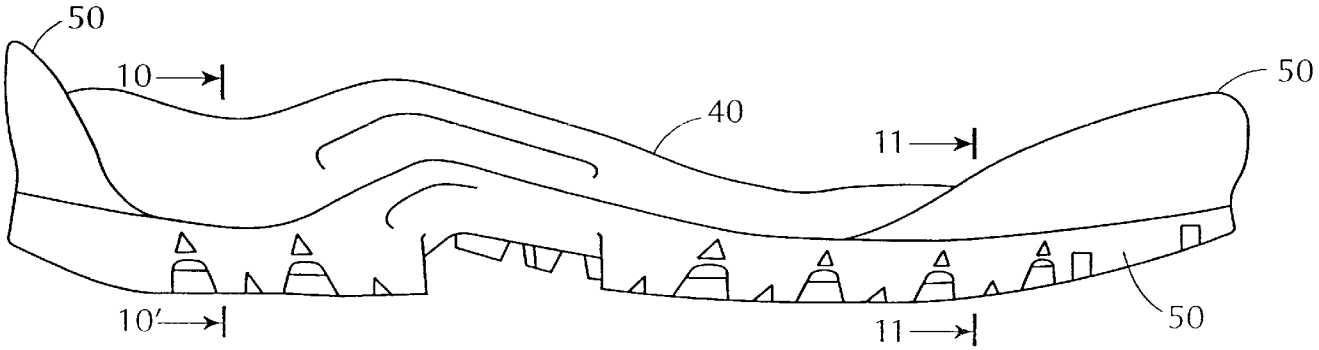
FIG. 9 is a side view of a full outsole with the midsole inserted into the outsole.
Figure 12:
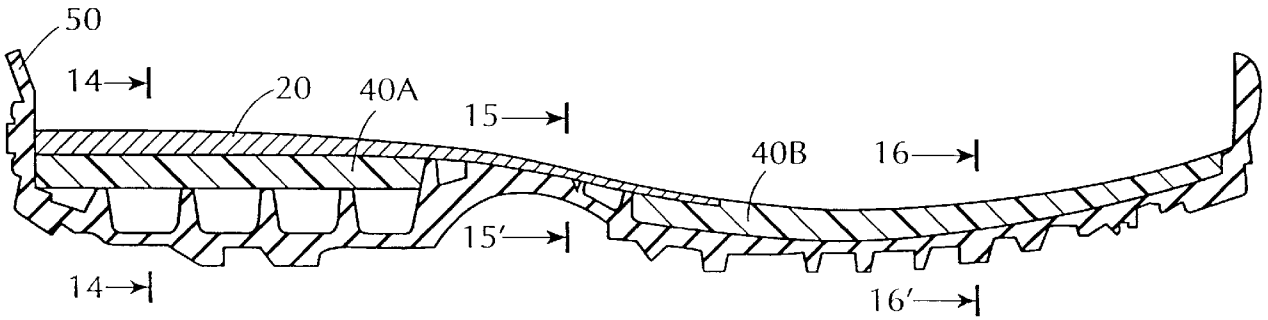
FIG. 12 is a lengthwise cross-sectional view of the sole of a shoe constructed in accordance with another embodiment of the invention having a two-section midsole.
Figure 10:
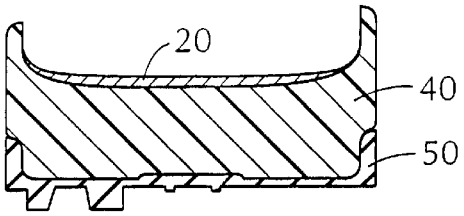
FIG. 10 is a cross-sectional view along line 10-10' of FIG. 9.
Figure 11:
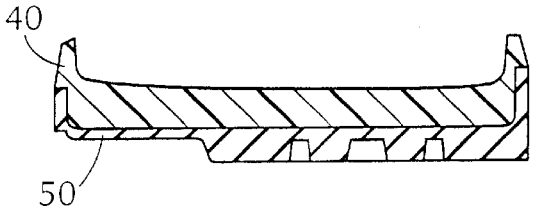
FIG. 11 is a cross-sectional view along line 11-11' of FIG. 9.

The outsole 50 in the embodiment of FIG. 8 extends upward above midsole 40 in the areas around the toes and behind the heel. (FIG. 9) However, midsole 40 is exposed in the central portion of the shoe (FIG. 9). FIGS. 10 and 11 are sectional views through the heel along line 10-10' (FIG. 9) and through the forepart of the sole along line 11-11', respectively.

A second embodiment of a midsole/outsole structure for use in the present invention is shown in FIGS. 12–16. In this embodiment, which varies slightly from the first embodiment, the midsole 40 does not extend under the entire foot. The midsole is comprised of two sections: section 40A underlies the heel and section 40B underlies the forepart of the foot. (FIG. 12) The midsole sections 40A and 40B are constructed more simply than in the first embodiment, being die cut from a flat sheet of EVA or other suitable material. Midsole sections 40A and 40B are cemented into recesses in the outsole and the outsole is then cemented to the combined upper and insole.

Figure 13:
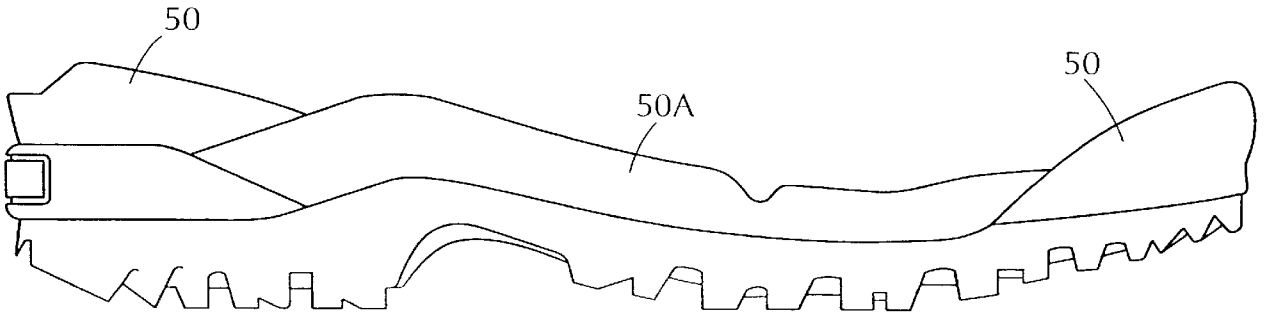
FIG. 13 is a side view of outsole of the shoe according to the embodiment of FIG. 12.

FIG. 13 is a lateral view of the outsole 50 in this second embodiment. The central portion 50A is an integral part of the outsole 50 and, therefore the midsole sections 40A and 40B are not exposed.

Figure 14:
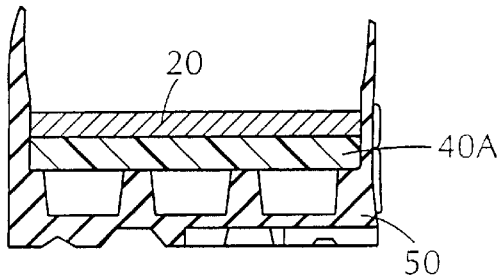
FIG. 14 is a cross-sectional view along line 14-14' in FIG. 12.
Figure 15:
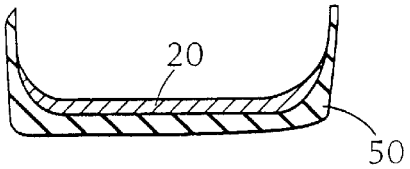
FIG. 15 is a cross-sectional view along line 15-15' in FIG. 12.
Figure 16:
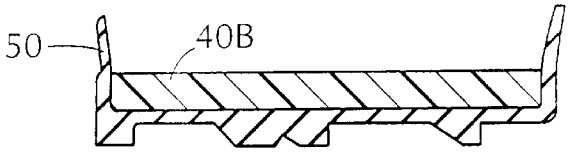
FIG. 16 is a cross-sectional view along line 16-16' in FIG. 12.

FIGS. 14, 15 and 16 are sectional views through the heel along line 14-14' (FIG. 12), through the area between midsole sections 40A and 40B along line 15-15', and through the forepart of the sole along line 16-16', respectively.

Because it eliminates the need for a steel shank, a half texon board and other components used to stiffen the shank region of the shoe, the present invention reduces the number of components used. For example, in the second embodiment, described above, only three components must be assembled on the last, viz., the plate, the shock diffusion flexible forepart, and the upper, as opposed to a greater number of components where a steel shank is used. This component consolidation reduces manufacturing costs. Also, as discussed above, the present invention also allows for a lighter, lower density midsole 40 wherein pressure from heel strike is dispersed over more of the surface of the midsole 40.

Because of the rigidity of the rear of the shoe, the shoe's shock absorption characteristics do not degrade over time.

One skilled in the art will recognize that modifications and variations can be made to the above described embodiments without departing from the scope of the invention. For example, in the first embodiment the molding details may be changed and the midsole may be made from EVA instead of polyurethane. Moreover, although a particular form of outsole is described above, the invention is not limited to use with a specific outsole or midsole in order to obtain the desired shock diffusion characteristics.

What is claimed is:

1. A shoe for a wearer having a foot with a bottom contour, the shoe having a heel area, an arch area and a forepart area and comprising:

a combination insole board;

an upper having a lasting margin at the heel area and a feather edge at the forepart area, the upper being lasted to the combination insole board;

an outsole attached to the upper; and a midsole having a top face, wherein the midsole is positioned between the combination insole board and the outsole;

wherein the combination insole board comprises:

a semi-rigid shock diffusion plate positioned exclusively in the heel and arch areas of the shoe contoured to approximately match the bottom contour of the wearer's foot to permit the diffusion of the force placed on the shoe during heel strike by the wearer;

wherein the semi-rigid shock diffusion plate has a top surface, a bottom surface, a central portion and a substantially U-shaped periphery, wherein the bottom surface is positioned on the top face of the midsole;

wherein the upper extends along an outer portion of the periphery of the shock diffusion plate and the bottom surface of the shock diffusion plate is attached to the lasting margin;

wherein the central portion of the shock diffusion plate is integrally formed with and extends contiguously within the periphery such that no opening is formed within the periphery;

wherein the bottom surface of the semi-rigid shock diffusion plate is substantially flat, the top surface at the periphery is curved upward, away from the central portion such that the top surface forms a cavity to cradle the wearer's foot;

a flexible material fixedly attached to the semi-rigid shock diffusion plate and positioned in the forepart area of the shoe on at least a portion of the midsole.

* * * * *